US005716203A

United States Patent [19]

Sirand

[11] Patent Number: 5,716,203

[45] Date of Patent: Feb. 10, 1998

[54] INJECTION APPARATUS FOR AN ATMOSPHERIC BURNER IN A GAS HEATING APPARATUS, ESPECIALLY OF THE INFRARED TYPE, AND HEATING APPARATUS PROVIDED WITH SUCH AN INJECTION DEVICE

[76] Inventor: Joseph Sirand, 47310 Laplume, France

[21] Appl. No.: 396,909

[22] Filed: Mar. 1, 1995

[30] Foreign Application Priority Data

Mar. 1, 1994 [FR] France ..... 94 02606

[51] Int. Cl.[6] ..... F23N 3/02

[52] U.S. Cl. ..... 431/89; 431/62; 126/92 B

[58] Field of Search ..... 431/89, 121–123, 431/62, 354; 126/92 B, 92 R, 92 AC

[56] References Cited

U.S. PATENT DOCUMENTS

| | | | |
|---|---|---|---|
| 1,716,325 | 6/1929 | Rogers | 431/89 |
| 2,449,237 | 9/1948 | Landon | 431/62 |
| 2,572,675 | 10/1951 | Swenson et al. . | |
| 2,939,524 | 6/1960 | Mathis et al. . | |
| 3,331,424 | 7/1967 | Heinrich . | |
| 3,599,661 | 8/1971 | Cushman . | |
| 3,726,629 | 4/1973 | Eschman | 431/89 |
| 3,753,642 | 8/1973 | Lamoureux | 431/89 |
| 4,090,839 | 5/1978 | von Linde | 431/89 |
| 4,793,798 | 12/1988 | Sabin . | |
| 5,060,629 | 10/1991 | Sirand . | |
| 5,238,398 | 8/1993 | Harris . | |

FOREIGN PATENT DOCUMENTS

| | | |
|---|---|---|
| 0 489 720 A3 | 6/1983 | European Pat. Off. . |
| 535137 | 9/1931 | Germany . |
| 2151611 | 4/1973 | Germany . |

*Primary Examiner*—James C. Yeung

*Attorney, Agent, or Firm*—Harold H. Dutton, Jr.; W. Charles L. Jamison; Diane S. Liebman

[57] ABSTRACT

The invention relates to an injection device for burner heating apparatus provided with an air/gas mixture conduit including a Venturi element. This injection device comprises an injector holding tube (14), secured to a valve body (15) divided internally into two chambers by a membrane (23): an idle chamber (24) subjected to the pressure of the gas and communicating with the injector holding tube (14), and a compensation chamber (25) set to atmospheric pressure, enclosing a spring (27) able to urge the membrane (23) toward an idle mode state. This injection device comprises further a rod (31) secured to the membrane (23) and associated with idle mode stop means (34), said rod being extended by a tapered needle (33) arranged to traverse the injector (13) and determine with the latter a cross-section for the idle mode gas outlet, when the pressure of the gas is less than or equal to the idle mode pressure.

9 Claims, 7 Drawing Sheets

INJECTION APPARATUS FOR AN ATMOSPHERIC BURNER IN A GAS HEATING APPARATUS, ESPECIALLY OF THE INFRARED TYPE, AND HEATING APPARATUS PROVIDED WITH SUCH AN INJECTION DEVICE

This invention relates to an injection apparatus for a atmospheric gas burner in a heating apparatus, especially of the infrared type, associated with regulator means for controlling the pressure of the gas delivered to the burner as a function of temperature regulating data, and comprising an air inlet conduit provided with an air inlet opening and a Venturi element, said injection apparatus being of the type comprising injection means arranged in the air inlet conduit of each burner, upstream of the Venturi element. The invention also extends to heating apparatus, particularly of the infrared type, provided with such an injection apparatus and applies most particularly to such heating apparatus which is called upon to function at a low nominal pressure.

BACKGROUND AND OBJECTS OF THE INVENTION

In the current state of technology, burners operating at low pressure, that is at a pressure generally lower than 500 mbar, are affected by a deterioration of the quality of the combustion if the feed pressure drops below the nominal value for which they are designed.

In effect, the equilibrium of the dosage between the injected burning gas and the aspirated combustion air is only satisfactory under the limits of a narrow range below the nominal pressure.

This state of facts prevents the use of regulation by degressive variation of the feed pressure down to a standby stage and leads to the use of an "all or nothing" regulator thereby necessitating electric reignition or a pilot light.

It will be noted that this disadvantage relative to the impossibility of obtaining a large range of control by variation of the nominal pressure, without causing a deterioration of the quality of combustion, diminishes and disappears rapidly when the apparatuses are provided for operation at pressures greater than 1 Bar. The range of good carburation increases in effect when the pressure is elevated, and thus with apparatus provided for operation at a pressure of 1.4 Bar, for example, for normal operation, one can reduce the pressure to an idle pressure of 0.02 Bar.

The problem thus relates to "low pressure" apparatus either, by way of example, an apparatus operating at a nominal pressure of 350 mbar for which the admission of aspirated air and the injection of gas delivered by the injector do not remain proportional over a range of pressure decreasing below 50% of the nominal mode.

The present invention seeks to solve this problem and has as an essential object to provide an injection apparatus permitting obtaining a good carburation of the atmospheric gas burners provided for operation at nominal low pressure mode.

DESCRIPTION OF THE INVENTION

To this end, the invention seeks to provide an injection device for gas atmosphere burners for heating apparatus, especially of the infrared type, associated with control means able to regulate the gas pressure delivered to the burner as a function of temperature regulation data, and comprising an air inlet conduit provided with an air inlet opening and a Venturi element.

According to the invention, the injection means comprises:

an injector holding tube, having at one of its ends, an injector provided with a calibrated injection nozzle, and fastened at its opposite end to a valve body comprising an adjustment orifice in a gas feed conduit and a connecting conduit between said orifice and the injector-holding tube, said valve body enclosing:

a membrane delimiting in a sealed manner two chambers: one chamber, called the pilot chamber, communicating respectively with the adjustment orifice and the injector holding tube, and a second chamber, called the compensation chamber, set to atmospheric pressure, elastic means arranged in the compensation chamber and arranged to urge the membrane toward an initial, rest position, when the pressure of the gas delivered to the burner is lower than or equal to a minimal, idle pressure, and for contracting in such a manner as to cause a deformation of said membrane when the gas pressure becomes greater than the idle pressure, a rod housed in the injector holding tube having a diameter adapted to provide an annular volume on the interior of said injector holding tube, said rod comprising:

one end fixed to the membrane so as to be able to slide longitudinally inside the injector holding tube as a result of deformations of said membrane resulting from fluctuations in the pressure of the gas delivered to the burner, an opposite end having the shape of a needle provided with a tapered end portion for extending partially into the extension of the injection nozzle and for defining with said injection nozzle an outlet cross-section corresponding to a mode of operation, called an idle mode, when the pressure of the gas is less than or equal to the idle pressure, idle mode stop means associated with the rod, able to limit displacements of said rod when the pressure of the gas is less than or equal to the idle mode, in such a manner as to obtain a precise positioning of the needle corresponding to the idle mode.

The present invention therefor comprises providing an injection apparatus of very simple design in which the modulations of the gas pressure controlled by regulator means are amplified at the point of the injection apparatus, without the need for external actuating means. In effect, the gas itself is used to auto-pilot this injection device by the deformation of a membrane wherein one of its faces is subjected to the pressure of the gas and the other face is subjected to the atmosphere, and wherein deformations bring about a variation in the cross-section of the gas outlet due to a longitudinal displacement of a needle relative to the injection nozzle, which leads to obtaining, at all modes, a precise equilibrium between the injected combustion gas and the aspirated combustion air.

In addition, the position of the needle corresponding to the critical idle mode is precisely defined because of the fact that the presence of the stop means for the idle mode which assures obtaining an outlet cross-section determined in a precise manner when the gas pressure becomes equal to or less than the retarded pressure.

Moreover, the fact that the needle passes through the injection nozzle and extends partially into the extension thereof, at the idle mode and in the range of lower pressures, is of fundamental importance. In effect, this positioning permits, in the range of lower pressures, not only to reduce the flow of gas, but also to guide the flow in such a manner as to obtain a laminar flow, that is without turbulence inside the nozzle, in order to maintain the speed of flow of the gas and to permit the secondary aspiration of air flow necessary for good combustion.

It will be appreciated that in the range of lower pressures, the progressive withdrawal of the needle leads to a progressive diminution of this "mechanical" guiding of the gas flow. However, the corresponding increase of the gas pressure assures, by itself, an increasing laminar flow necessitating less and less the resort to "mechanical" guiding for avoiding turbulences and therefor disruption and degradation of the aspirated air necessary.

Furthermore, beyond a pressure of a given value, the gas pressure is sufficient in order that the flow of the gas flows through the nozzle in a laminar fashion without the help of the guiding action of this flow by the needle.

By way of example, the lower pressure region anticipated hereinabove extends between the pressure of the idle mode and essentially ⅖ and ⅓ of the nominal pressure. However, these values are functions of the pressure range determined by the regulator means, and the lower is this pressure range, the more important will be the range in which the pressure is called lower, on which the needle must contribute its convergence to assure a "mechanical" guiding of the gas flow.

In practice, it has been established that such concept of an injection device permits modulating the operation of a burner functioning at low pressure between a maximum nominal power and a minimum idle power, and this without affecting the quality of combustion.

This quality of combustion has been verified during operation of infrared heating apparatus in which it is known that the transformation between infrared radiation of an important percentage of the calorific power carried out necessitates, at all modes, an optimization of the proportions of the air/gas mixture.

One should also note that just as developed above, this quality of combustion is obtained by means of an injection device in which the piloting is assured solely by variations in the pressure of the gas, without the necessity of controlling any other parameters such as the quantity of combustion air.

Such a concept leads to a notable simplification with respect to known devices such as are described in U.S. Pat. No. 2,572,675, European patent 489,720 or U.S. Pat. No. 4,793,793 which comprise non-self-piloting, complex control devices arranged in the air feed conduit, or a device described in U.S. Pat. No. 5,238,398 which comprises a valve with a variable orifice arranged in the gas feed conduit and powered by a stepping motor.

According to another characteristic of the invention, the stop means for the idle mode comprises a stop member fixed to the membrane and the rod, and a stop shoulder arranged in the pilot chamber.

Moreover, according to another characteristic of the invention, the tapered end portion of the needle intended to define the outlet cross-section of the idle mode and on a predetermined path corresponding to variations in pressure of the gas delivered between the idle pressure and a predetermined value within the range of variation of said gas pressure, presents a non-linear profile of at least two different decreasing values from the anterior end of said needle toward its portion of juncture with the rod.

The tapered end portion may thus advantageously have an ogival shape.

This shape of the tapered end portion of the needle permits obtaining, in the lower range of pressures, a progression of the gas outlet cross-section less rapid than that which would be obtained with, for example, a needle having a conical end portion.

As will be understood further herebelow, this solution has for an advantage permitting obtaining much more easily an optimization of the proportions of the air/gas mixture and notably improving the proportionality between the power furnished and the pressure of the gas, over the whole pressure range.

The invention extends to a heating apparatus especially of the infrared type, comprising a gas atmosphere burner comprising an air inlet conduit provided with an air inlet opening and a Venturi element, said heating apparatus being characterized in that it comprises an injection device according to the invention.

DESCRIPTION OF THE DRAWINGS

Other characteristics, objects and advantages of the invention will become apparent from the detailed description which follows in reference to the accompanying drawings which show, by way of non-limiting example, a preferred embodiment of the invention. In these drawings which form an integral part of the present description.

DESCRIPTION OF THE PREFERRED EMBODIMENTS

Figure 1:
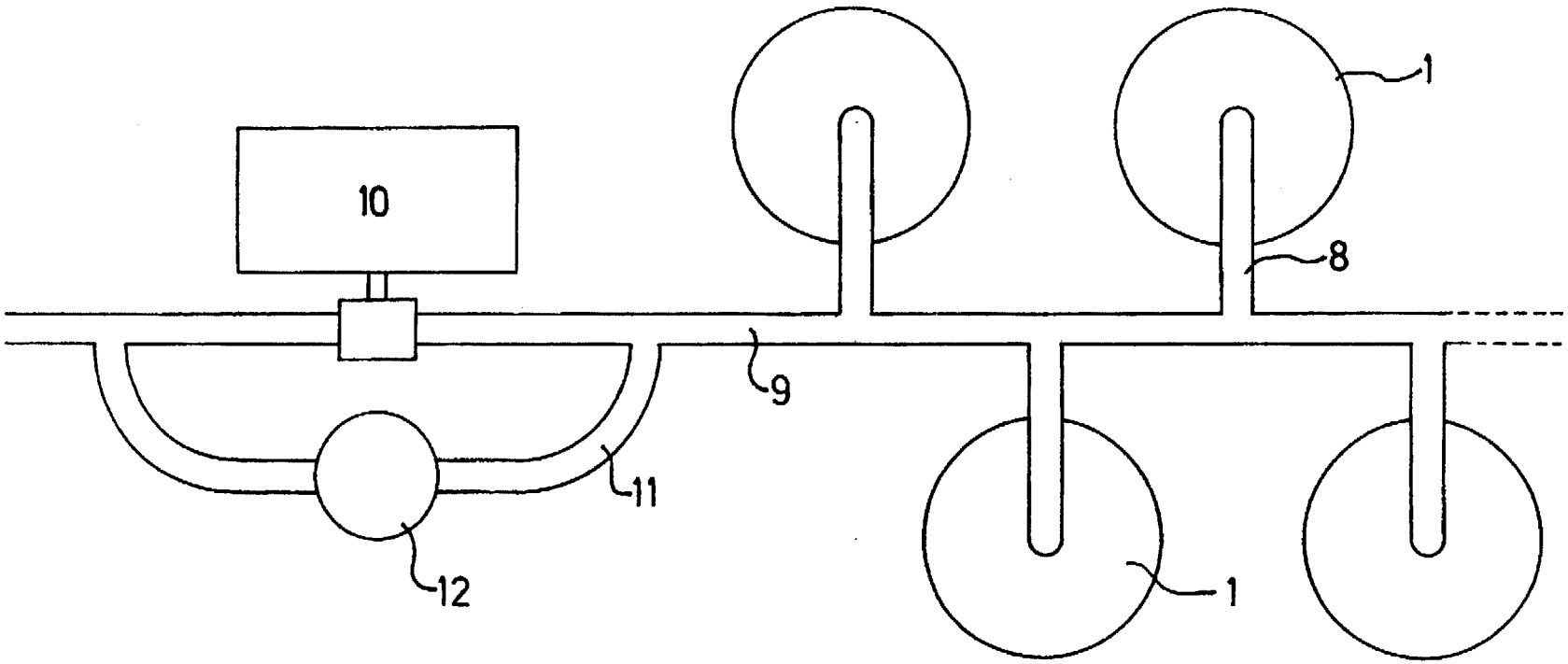
FIG. 1 is a schematic view of the principle of a heating installation comprising several heating devices of the infrared type, and centralized control means, such as provided by the invention.

The injection device according to the invention is shown in the drawings associated with infrared heating apparatus 1 such as are used in the agricultural field for heating breeder buildings.

Figure 2:
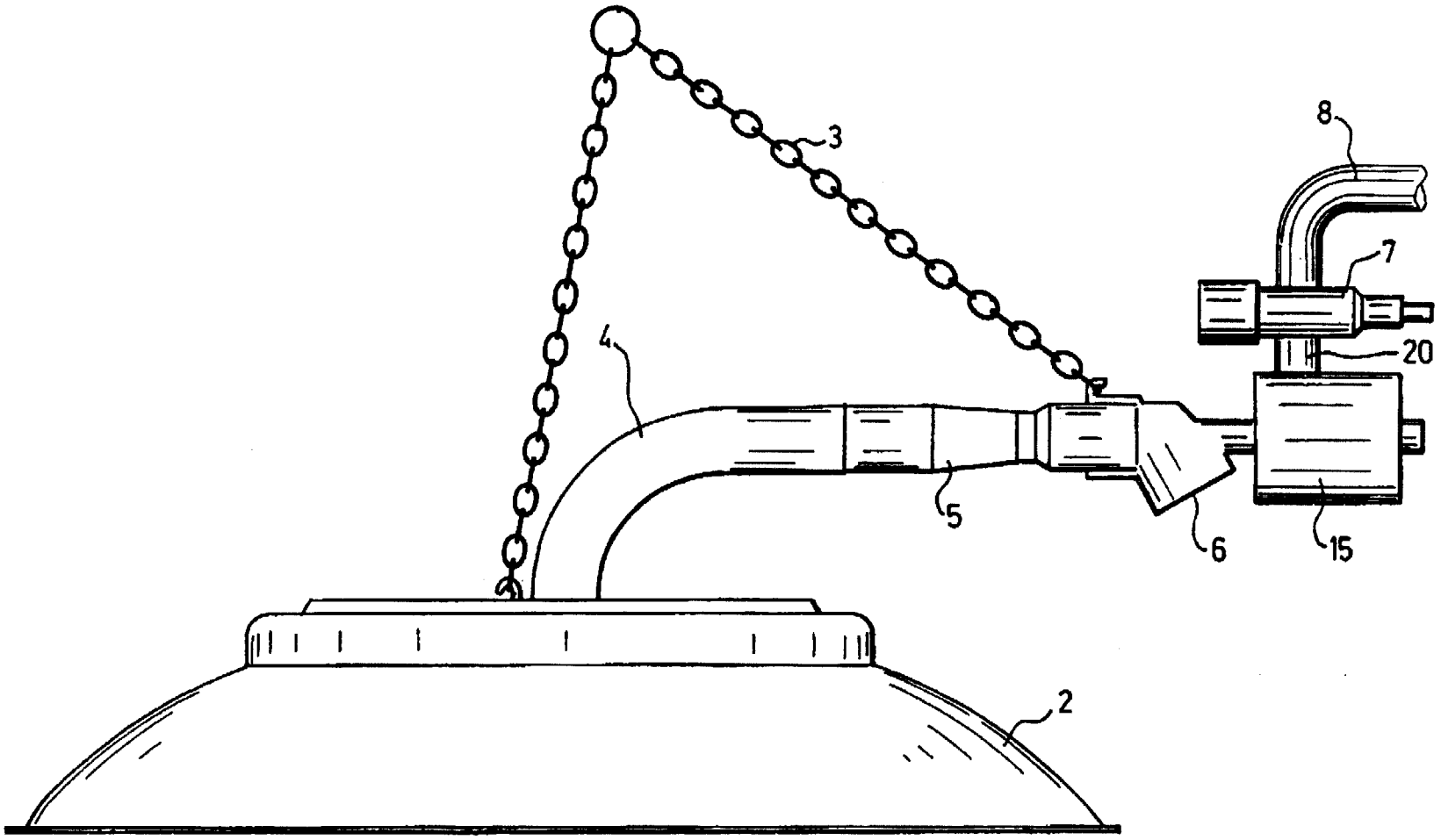
FIG. 2 is a lateral schematic view of an infrared heating apparatus of the type used in the heating installation shown in FIG. 1, provided with an injection device according to the invention.

As is shown in FIG. 2, such heating apparatus 1 comprises in the first place a reflector 2 having the shape of a cupola intended to be suspended from above the selected site by, for example, a chain 3, and enclosing the diffusion, combustion and radiation members (such members are not shown and may be of the type as those described in U.S. Pat. No. 5,060,629 in the name of the applicant).

Each heating apparatus 1 comprises further a feed conduit for the air/gas mixture comprising a curved conduit 4 provided, in a conventional manner, with a Venturi element 5 and an inlet opening 6 for the primary combustion air.

This heating apparatus 1 also includes, in a conventional manner, a safety valve 7 branched on a gas feed conduit 8 of the apparatus, and of which the outlet is connected to a gas injection device upstream of the Venturi element 5 and described hereafter.

According to the invention, such heating apparatus are intended to operate in a low pressure nominal region with the possibility of modulating their normal operation to a minimum idle mode.

Further, the control means permitting this modulation is centralized and therefor common to several heating devices.

FIG. 1 shows such an installation provided with centralized control means, comprising a primary feed conduit 9 to which is connected gas feed conduits 8 for the heating devices.

This centralized control means comprises, in a conventional manner, a control panel 10 with a thermostatic valve or a pressure reduction valve controlled by a servomotor, all being arranged in parallel with respect to a bypass conduit 11 on which is arranged a idle pressure reduction valve 12.

Figure 3:
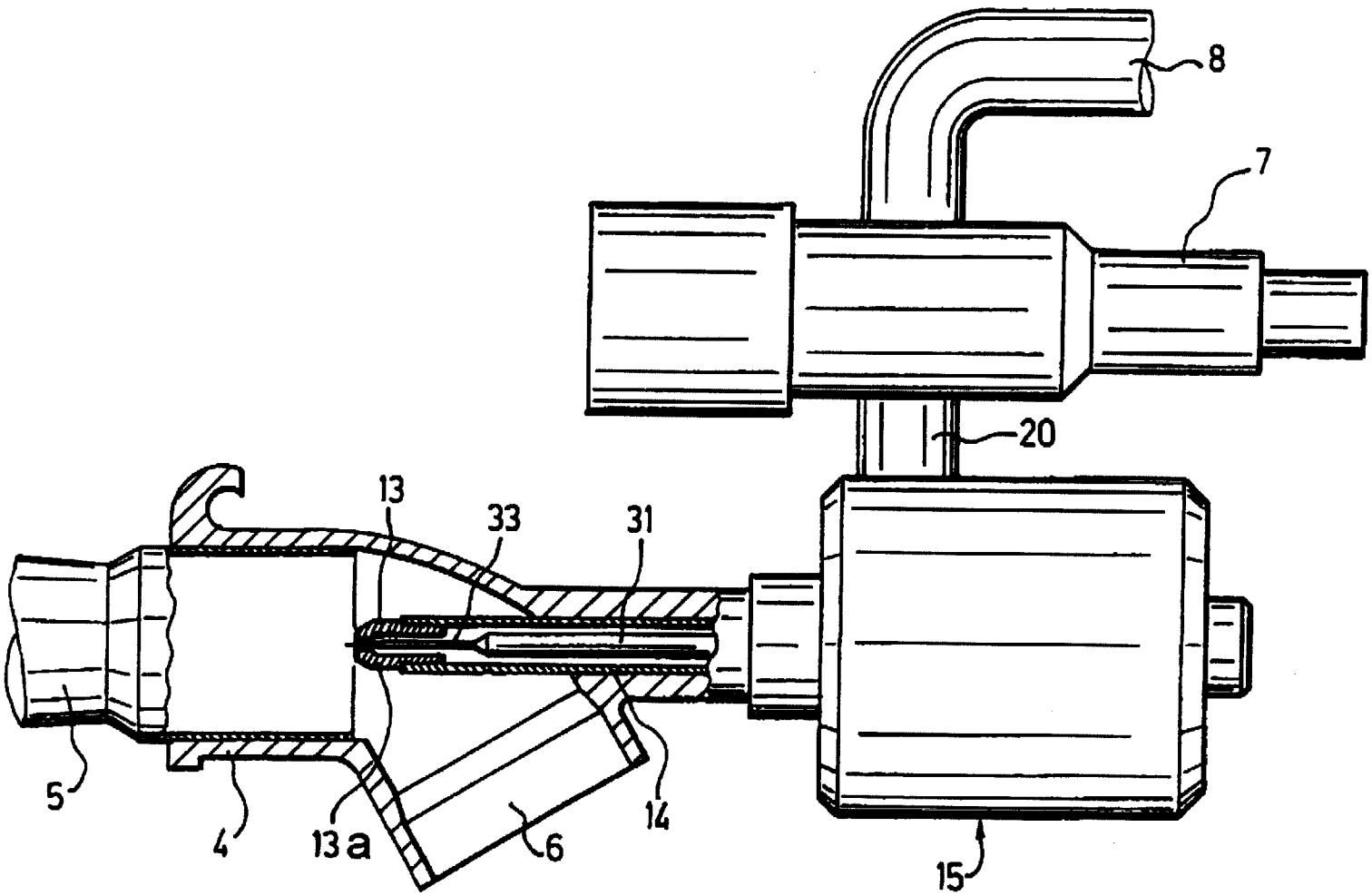
FIG. 3 is a longitudinal schematic view on an enlarged scale, partially in cross-section along an axial plane, of the air and gas feed means for the heating apparatus of FIG. 2.
Figure 4:
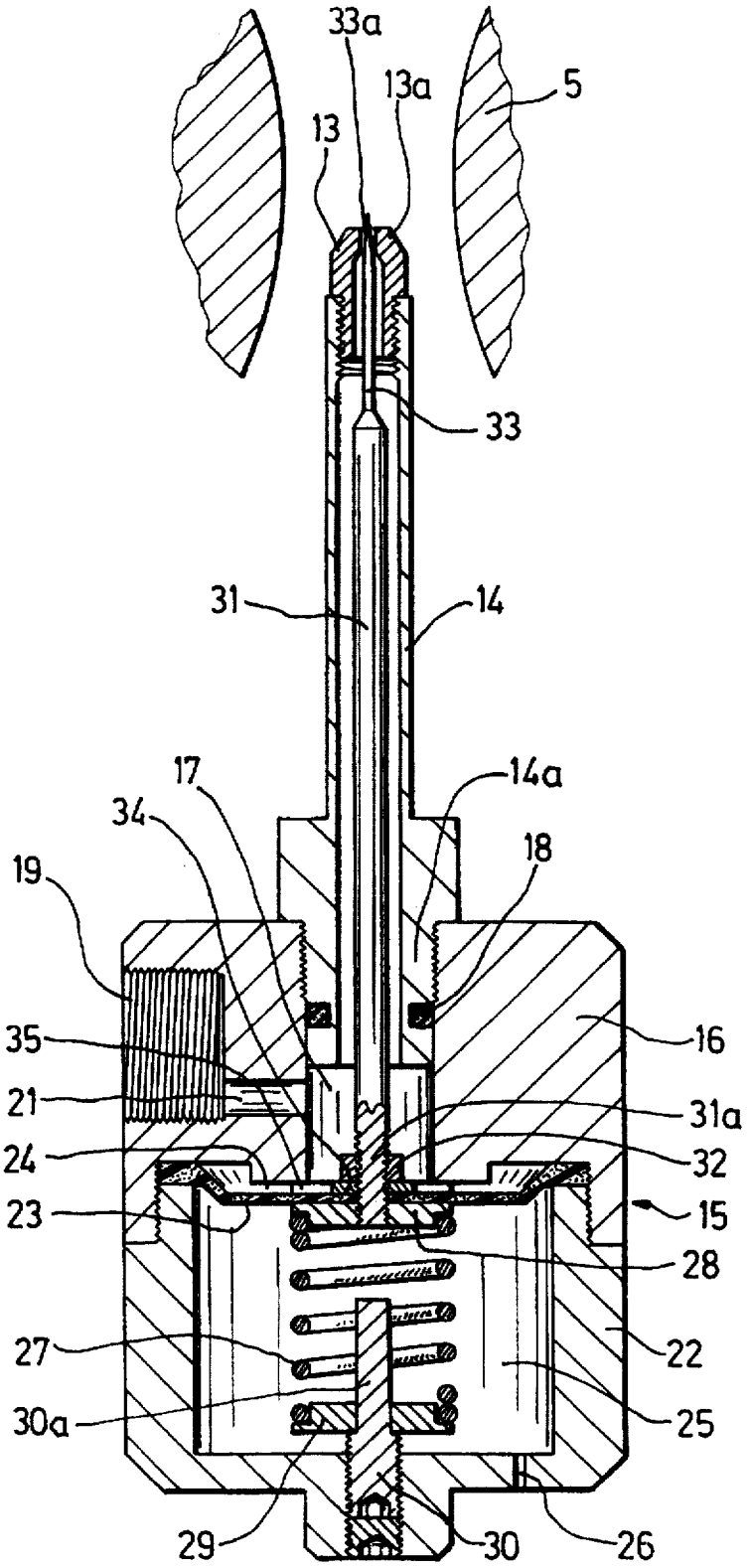
FIG. 4 is a longitudinal cross-section along an axial plane of an injection device according to the invention.

As is shown in FIG. 3 and 4, the injection device equipping each of the heating apparatuses 1 comprises an injector 13 provided with a calibrated, cylindrical injection nozzle 13*a* arranged in the conduit 4 upstream of the Venturi element 5.

This injector 13 is aimed on the end of an injector holding tube 14 provided for this purpose with a threaded end portion, the other end of which is secured to a pilot valve 15.

This pilot valve comprises, in the first place, a valve body 16 axially pierced by a longitudinal bore 17, threaded at one of its ends, for permitting threaded attachment of the valve body and the injector holding tube 14, provided for this purpose with an integral threaded ferrule 14*a*.

Furthermore, this threaded ferrule 14*a* and the threaded portion of the bore 17 are initially coated with a slow acting sealing product able to permit pre-regulation of the relative position of the valve body 16 and the injector holding tube 14 under gas pressure. In order to assure the tight seal during this pre-regulation, the threaded ferule 14*a* of the injector holding tube 14 comprises an annular groove housing an O-ring 18.

The valve body 16 comprises further a lateral orifice 19 threaded for connection with a gas conduit 20 extending between said valve body and the safety valve 7, said lateral orifice communicating with the longitudinal bore 17 and therefor with the injector holding tube 14 through the intermediary of a radial bore 21 emptying into the lateral orifice 19.

The pilot valve 15 also comprises a bonnet 22 adapted to be screwed frontally onto the valve body 16, on an extension thereof opposite the injector holding tube 14, and adapted to form with said valve body, at the point of their junction, an internal annular groove housing the periphery of a membrane 23 closing the bonnet and defining in a sealed manner two chambers: a pilot chamber 24 subjected to the pressure of the gas and communicating with the lateral orifice 19 and the injector holding tube 14, and a compensation chamber 25 occupying almost all of the volume defined by the bonnet 22, brought to atmospheric pressure by a vent hole 26 provided in the bonnet.

The pilot valve 15 comprises, further, a spring 27 arranged in the compensation chamber 25, between a floating piece 28 secured to the membrane 23 and a stop piece 29 associated with manual calibration control means for the spring 27 functioning as well as a stop for the nominal mode able to limit deformations of the membrane 23 when the gas pressure becomes greater than a predetermined value corresponding to the nominal mode. For this reason, the calibration control means for the spring 27 permits also the control of the position of the nominal mode stop.

This control means comprises a screw 30 housed in a threaded orifice provided in the frontal wall of the bonnet 22, extending into the interior of said bonnet through a cylindrical needle 30*a* having a smaller diameter, separated from the tapered portion of said screw by a shoulder.

The stop piece itself comprises a ring, the diameter of the orifice of which is adapted such that the ring is arranged around the needle 30*a*, in abutment against the shoulder of the screw 30. In this manner, the screwing in or unscrewing of the screw 30 modifies the calibration of the spring 27, and permits independent control of the distance between the end of the needle 30*a* and the membrane 23.

The injection device comprises a rod 31 housed in the injector holding tube 14, of a diameter adapted to provide an annular space on the interior of the tube.

This rod 31 has a threaded posterior end portion 31*a* extending in a sealed manner through the membrane 23, and secured by screw threads to the floating piece 28, the blockage relative to said rod and said floating piece being assured by a lock nut 32.

On the opposite side, a needle 33 extends from this rod 31, for example formed extending from said rod, having a length greater than that of the injector 13, the threading of the latter included, such that the needle opens to the exterior of this injector 13 under idle mode operating conditions without the admission of gas into said injector being prevented by the base of the rod 31.

Figure 7:
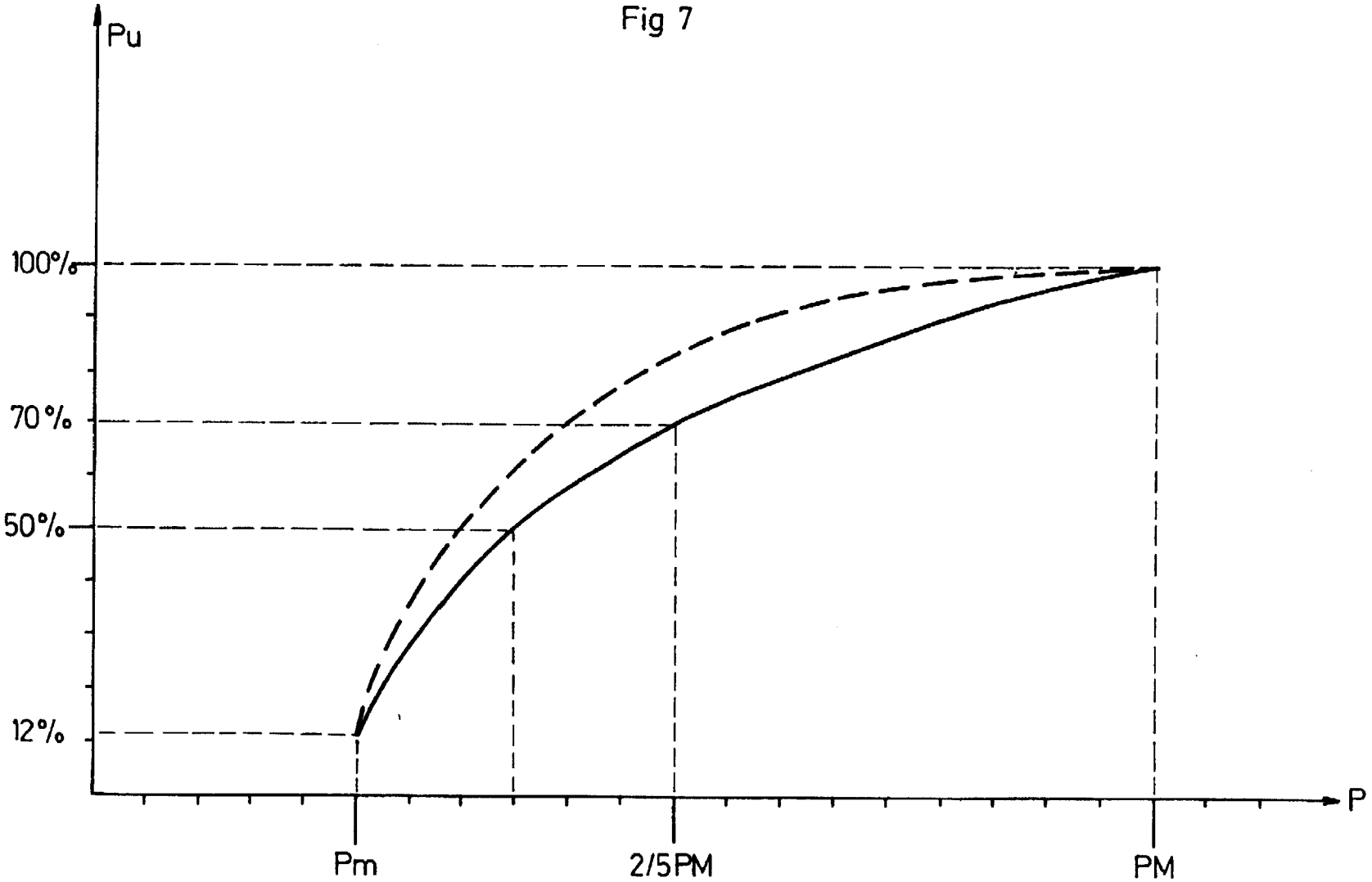
FIG. 7 shows comparative curves of the power obtained as a function of the pressure of the gas, respectively with a needle according to the invention and with a needle having a conical end.
Figure 8:
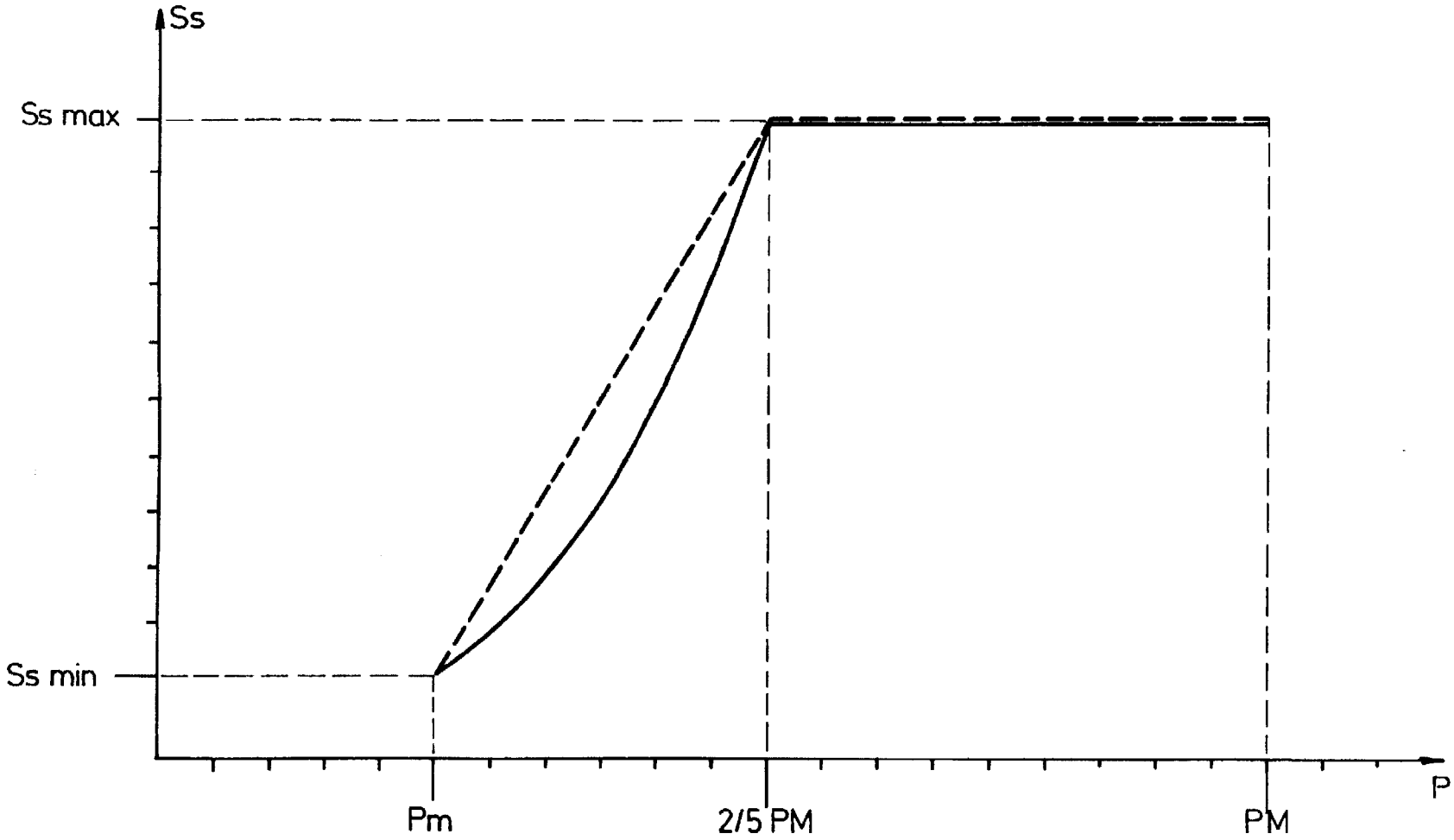
FIG. 8 shows comparative curves of the diameters of the gas outlet cross-section as a function of the pressure of the gas, respectively with a needle according to the invention and with a needle having a conical end portion.

This needle has, furthermore, an end portion 33*a* having an ogival shape, the interest in which with respect to a conventional conical shape appears from FIGS. 7 and 8 (in these figures, the curves corresponding to the ogival shape according to the invention are in solid line, and the curves corresponding to a conventional conical shape are shown in broken lines).

The curves shown in FIG. 8, which represent the evolution of the cross-section Ss of the gas outlet as a function of the feed pressure P of this gas, show that in a range of lower pressures, comprising for example between the minimal idle pressure Pm and ⅗ of the nominal pressure PM, the outlet section increases less rapidly with a needle whose end portion has an ogival shape than with a needle whose end portion is conical.

As shown in FIG. 7, on which is shown the evolution of the power Pu of the heating apparatus (in percent) as a function of the feed pressure P of the gas, this difference in cross-section of the outlet conduit produces a power curve much better staged with a needle having an end portion of an ogival shape with respect to a needle having an end portion of a conical shape.

Figure 5:
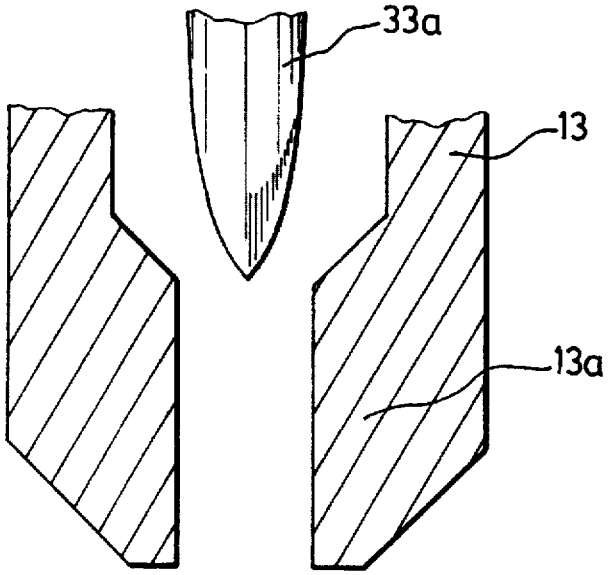
FIGS. 5 and 6 are partial longitudinal cross-sections along an axial plane, on an enlarged scale, showing the position of the needle respectively for a value of the pressure equivalent to the upper region of the range of lower pressures, and the idle region.
Figure 6:
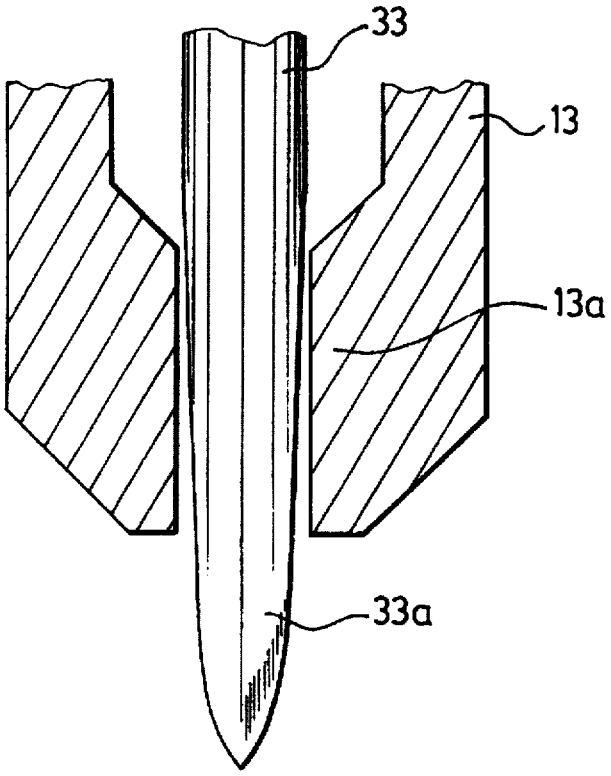

In addition, as shown in FIG. 5 and 6, the rod 31 and the longitudinal displacement means of the latter (membrane 23, spring 27, . . . ) are adapted such that:

- in the idle mode, the needle 33 extends partially into the extension of the injection nozzle 13*a* in such a manner as to guide the flow of gas and obtain a laminar flow permitting an induced aspiration of air flow necessary for good combustion (FIG. 6),
- the needle 33 moves backward progressively upon an increase in pressure in such a manner as to cause a progressive increase in the cross-section of the injection nozzle 13*a*, the intermediary position shown in FIG. 5, where the extremity of this needle 33 disappears with respect to the injection nozzle 13*a*, corresponding for example to a gas feed pressure equal to ⅔ of the nominal pressure. At the time of this backward movement, the diminution of the "mechanical" guiding of the gas flow is compensated by the increase of the gas pressure which assures, itself, an increasing laminar flow.

Finally, the injection device comprises a stop member 34 for the idle mode arranged such that the position of the needle 33 relative to the injection nozzle 13*a* is rigorously always the same. This stop member comprises a cup 34 interposed between the membrane 23 and the lock nut 32, around the rod 31, said cup having a diameter adapted to come to rest against the periphery of the bore 17 of the valve body 16, and comprising radial slots 35 permitting the passage of gas.

I claim:

1. An injection apparatus for gas burning infrared heaters, comprising a regulator means for controlling the pressure of the gas delivered to the burner as a function of temperature, an air inlet conduit (4) having an air inlet opening (6) and a Venturi element (5), said injection apparatus further including injection means in said air inlet conduit, said injection means comprising:

an injector holding tube (14) having an injector (13) near one end thereof, an injector member (13) having a calibrated injection nozzle (13*a*) and secured to a valve body (15), said valve body having an orifice (19) connected to a gas feed conduit (8, 20), a connecting conduit (17, 21) between said orifice (19) and said injector holding tube (14); said valve body further having an idle chamber (24) in communication with said orifice (19) and said injector holding tube (14), and a compensation chamber (25) at atmospheric pressure, and a membrane (23) separating said idle chamber and said compensation chamber;

elastic means (27) in said compensation chamber (25) for urging said membrane (23) toward an initial, rest position when the pressure of gas delivered to said burner is less than or equal to a minimum, idle pressure, and for contracting so as to permit deformation of said membrane when the gas pressure becomes greater than the idle pressure, a rod (31) housed in said injector holding tube (14) and defining with said injector holding tube (14) an annular space betweeen said rod (31) and said injector holding tube (14), said rod having one end (31*a*) thereof secured to said membrane (23) and slidable in said injector holding tube (14) upon deformation of said membrane, the other end of said rod comprising a needle having a tapered end portion (33*a*) extending partially into said injection nozzle, said needle and said injection nozzle defining therebetween a cross-sectional area corresponding to an idle mode when the pressure of the gas is less than or equal to the idle pressure, and stop means (34) associated with said rod (31) for limiting displacement of said rod in relation to said idle mode.

2. An injection apparatus as in claim 1 and wherein said stop means comprise a stop member (34) secured to said membrane (23) and said rod (31) and a stop shoulder arranged in said idle chamber (24).

3. An injection apparatus as in claim 1 and wherein said tapered end portion (33*a*) has a non-linear longitudinal taper with at least two different slopes for adjusting said cross-sectional area in a predetermined manner in relation to variations in the pressure of the gas.

4. An injection apparatus as in claim 3 and wherein said tapered end portion (33*a*) has an ogival shape.

5. An injection apparatus as in claim 1 and including a nominal mode stop means (30*a*) associated with said rod (31) for limiting displacement of said rod when the pressure of gas delivered is greater than a predetermined nominal mode value.

6. An injection apparatus as in claim 5 and wherein said nominal mode stop means (30*a*) includes means for controlling the relative longitudinal position of said rod (31).

7. An injection apparatus as in claim 1 and including manual control means (29, 30) for calibrating said elastic means.

8. An injection apparatus as in claim 1 and wherein said valve body (15) includes a threaded frontal bore (17) in communication with said connecting conduit (21), and said injector holding tube (14) having a threaded end portion (14*a*) for threadedly engaging said valve body, said threaded end portion further including an annular groove and an O-ring (18) seal therein enabling threaded adjustment of the position of said injector holding tube while said valve body contains gas under pressure.

9. An infrared gas burning heating apparatus comprising an atmospheric gas burner having an air inlet conduit (4) including an air inlet opening (6) and a Venturi element (5), and in combination an injection apparatus, said injection apparatus comprising a regulator means for controlling the pressure of the gas delivered to the burner as a function of temperature, said injection apparatus further including injection means in said air inlet conduit, said injection means comprising:

an injector holding tube (14) having an injector (13) near one end thereof an injector member (13) having a calibrated injection nozzle (13*a*) and secured to a valve body (15), said valve body having an orifice (19) connected to a gas feed conduit (8, 20), a connecting conduit (17, 21) between said orifice (19) and said injector holding tube (14); said valve body further having an idle chamber (24) in communication with said orifice (19) and said injector holding tube (14), and a compensation chamber (25) at atmospheric pressure, and a membrane (23) separating said idle chamber and said compensation chamber;

elastic means (27) in said compensation chamber (25) for urging said membrane (23) toward an initial, rest position when the pressure of gas delivered to said burner is less than or equal to a minimum, idle pressure, and for contracting so as to permit deformation of said membrane when the gas pressure becomes greater than the idle pressure, a rod (31) housed in said injector holding tube (14) and defining with said injector holding tube (14) an annular space between said rod (31) and said injector holding tube (14), said rod having one end (31*a*) thereof secured to said membrane (23) and slidable in said injector holding tube (14) upon deformation of said membrane, the other end of said rod comprising a needle having a tapered end portion (33*a*) extending partially into said injection nozzle, said needle and said injection nozzle defining therebetween a cross-sectional area corresponding to an idle mode when the pressure of the gas is less than or equal to the idle pressure, and stop means (34) associated with said rod (31) for limiting displacement of said rod in relation to said idle mode.

* * * * *